US011635084B1

(12) United States Patent
Feng

(10) Patent No.: US 11,635,084 B1
(45) Date of Patent: Apr. 25, 2023

(54) FAN LOGIC EVALUATION DEVICE AND METHOD THEREOF FOR IMPROVING THE LOGIC EVALUATION OF A FAN

(71) Applicant: Long Victory Instruments Co., Ltd., Taoyuan (TW)

(72) Inventor: Chien-Chung Feng, Taoyuan (TW)

(73) Assignee: LONG VICTORY INSTRUMENTS CO., LTD., Taoyuan (TW)

( * ) Notice: Subject to any disclaimer, the term of this patent is extended or adjusted under 35 U.S.C. 154(b) by 0 days.

(21) Appl. No.: 17/854,830

(22) Filed: Jun. 30, 2022

(51) Int. Cl.
*F04D 27/00* (2006.01)
*F04D 19/02* (2006.01)
*F04D 19/00* (2006.01)

(52) U.S. Cl.
CPC ..... *F04D 27/001* (2013.01); *F04D 19/002* (2013.01); *F04D 27/004* (2013.01)

(58) Field of Classification Search
CPC ..... F04D 27/001; F04D 19/002; F04D 27/004
See application file for complete search history.

(56) References Cited

U.S. PATENT DOCUMENTS

| | | | | |
|---|---|---|---|---|
| 5,099,685 | A * | 3/1992 | McLean | G01M 9/04 73/147 |
| 6,039,533 | A * | 3/2000 | McCabe | F04D 29/384 416/223 R |
| 6,116,095 | A * | 9/2000 | Radle | B60H 1/00364 73/756 |
| 10,254,195 | B1 * | 4/2019 | Braam | G01L 9/02 |
| 2010/0028134 | A1 * | 2/2010 | Slapak | G10K 11/17853 415/119 |
| 2017/0350412 | A1 * | 12/2017 | Hioki | F04D 29/5833 |
| 2018/0346108 | A1 * | 12/2018 | Sheng | B64C 21/025 |
| 2019/0242359 | A1 * | 8/2019 | Rider | F03D 1/025 |
| 2019/0329142 | A1 * | 10/2019 | Maida | F16H 57/04 |

* cited by examiner

*Primary Examiner* — Long T Tran
(74) *Attorney, Agent, or Firm* — WPAT, PC

(57) ABSTRACT

A fan logic evaluation device and method thereof for improving the logic evaluation of a fan. Specifically, a fan logic evaluation device is provided by first installing a fan, which corresponds to a set of parameters, in a wind tunnel device. A computer then performs a logic evaluation to convert the set of parameters into an evaluated pressure-flow curve and a measured pressure-flow curve by measuring the fan's operating conditions with the wind tunnel device. The computer further performs a logic modification to correct the logic evaluation to obtain a logic evaluation modification. The logic evaluation is then replaced by the logic evaluation modification. Finally, the above process is repeated with the same fan or a different fan.

8 Claims, 10 Drawing Sheets

FAN LOGIC EVALUATION DEVICE AND METHOD THEREOF FOR IMPROVING THE LOGIC EVALUATION OF A FAN

FIELD OF THE DISCLOSURE

The present disclosure relates in general to fan performance evaluation techniques, and more particularly, to a method for continuously improving the logic evaluation of a fan, and a fan logic evaluation device using the same method.

BACKGROUND OF THE DISCLOSURE

Conventional design techniques involving, for example, a fan used in the central processing unit (CPU) of a computer, requires a designer to mostly use an existing finished product, and adjust the values of the parameters, such as fan diameter, speed, number of blades, angle, and height of the fan blades according to his own needs, so that the designed fan can be suitable for the required occasion. The fan diameter, rotation speed, and height of the fan are adjusted according to your needs. Other parameters can be added depending on the requirements, such as fan blade wing shape, blade root chord length, blade end chord length, mounting angle, torsion angle, hub outer diameter, and blade top clearance.

After the designer adjusts the values of the above parameters according to his requirements, it is necessary to manufacture the products according to the parameters and install them in the wind tunnel for testing, and judge the performance of the fan by the actual measured pressure and flow curve (P-Q Curve). If the performance does not meet the designer's requirements, the designer often does not know which of the many parameters plays the key role, and therefore cannot find the key parameter to adjust when adjusting the parameters, and needs to test multiple samples to determine the best fan parameters.

The problem with the conventional art is that there is no effective method to evaluate the various parameters of the fan, which must be adjusted after actual production.

SUMMARY OF THE DISCLOSURE

It is therefore an object of the present disclosure to provide a method of continuously improving the fan logic evaluation, and a fan logic evaluation device using the same method to solve the aforementioned problems.

Another object of the present disclosure is to obtain an evaluated pressure flow curve by evaluating the pressure flow curve of the fan in the design stage. The logic evaluation can be continuously improved so that the pressure flow curve evaluated by the logic evaluation for each fan is closer to the actual measured pressure flow curve, and the evaluated pressure flow curve can be used by the designer without making the actual product.

In order to achieve the above-mentioned objects, the present disclosure uses a method for continuously improving the fan logic evaluation and a fan logic evaluation device using the method. The method includes the steps of: (a) preparing a fan installed in a wind tunnel device, wherein the fan corresponds to a set of parameters, the set of parameters at least include the values of fan diameter, speed, number of blades and height of fan blades, which are stored in a computer; (b) executing a logic evaluation with the computer, wherein when the logic evaluation is executed, an evaluation pressure flow curve is converted based on the set of parameters, and the wind tunnel device is equipped with a measuring device to measure air flow blown into or out of the wind tunnel device when the fan is running, and a measured pressure flow curve is obtained, and inputted into the computer; (c) executing a logic modification from the computer, wherein the logic evaluation is revised according to the difference between the measured pressure-flow curve and the estimated pressure-flow curve, and obtain a logic evaluation modification, and wherein, when the computer executes the logic evaluation modification, the new estimated pressure-flow curve obtained must be closer to the measured pressure-flow curve than the estimated pressure-flow curve obtained in the aforementioned step (b); (d) replacing the logic evaluation in the aforementioned step (b) with the logic evaluation modification; and (e) repeating the above steps (a) to (d), with each repetition having the same fan or of a different fan.

By using the above method, the disclosure can evaluate the pressure flow curve of the fan at the design stage, which allows the designer to evaluate the performance of the fan designed by the method. With the increase in the number of fan tests, the disclosure can continuously improve the logic evaluation, so that the pressure flow curve evaluated by the logic evaluation for each fan will be closer to the pressure flow curve measured in real time, and the pressure flow curve can be used directly by the designer without having to make the actual product to test.

Additionally, the disclosure provides a fan logic evaluation device based on the above method for achieving the purpose as stated above. Specifically, the fan logic evaluation device includes a wind tunnel device having an air vent and a mounting structure for the fan to be mounted on the air vent and for accommodating an airflow driven by the operation of the fan; a measuring device installed on the wind tunnel device; and a computer, electrically connected to the measuring device for reading the values sensed by the measuring device, and performing an evaluation procedure comprising the steps (a) through (d).

With the above technical features, the fan logic evaluation device provided in the present disclosure can obtain the evaluation pressure flow curve after inputting the parameters during the design of the fan, and this evaluation pressure flow curve itself is close to the actual measured pressure flow curve.

BRIEF DESCRIPTION OF THE DRAWINGS

In order to illustrate the technical features of the present disclosure in detail, exemplary embodiments are illustrated with drawings, wherein.

DETAILED DESCRIPTION OF THE EXEMPLARY EMBODIMENTS

In order to illustrate the technical features of the present disclosure in detail, the following exemplary embodiments are cited and illustrated with accompanying drawings, among others.

As shown in FIGS. 1 to 7, the first preferred embodiment of the present disclosure is directed to a method of continuously improving the fan logic evaluation, having the steps as set forth below.

Figure 1:
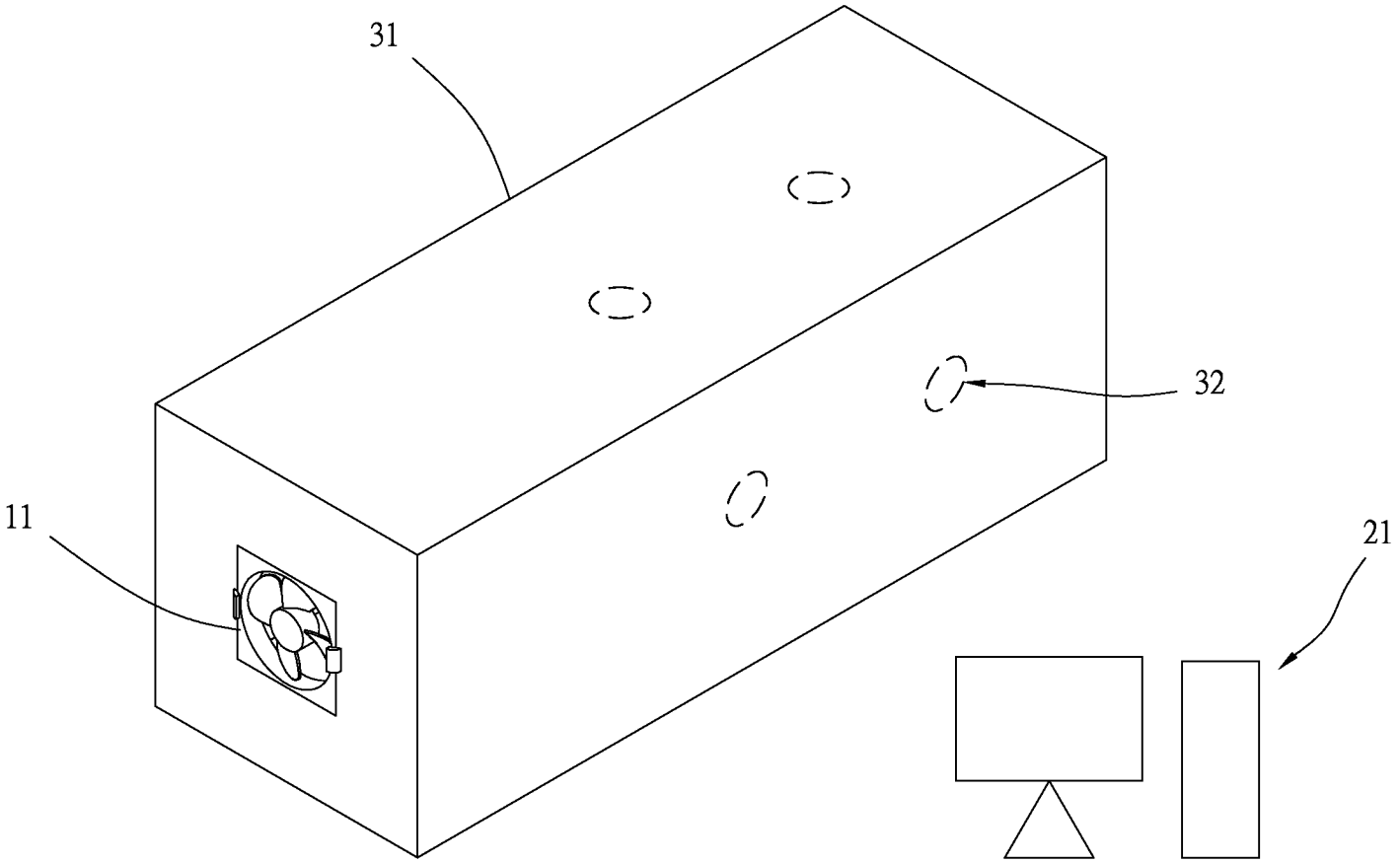
FIG. 1 is a perspective structure diagram according to a first exemplary embodiment of the present disclosure.
Figure 2:
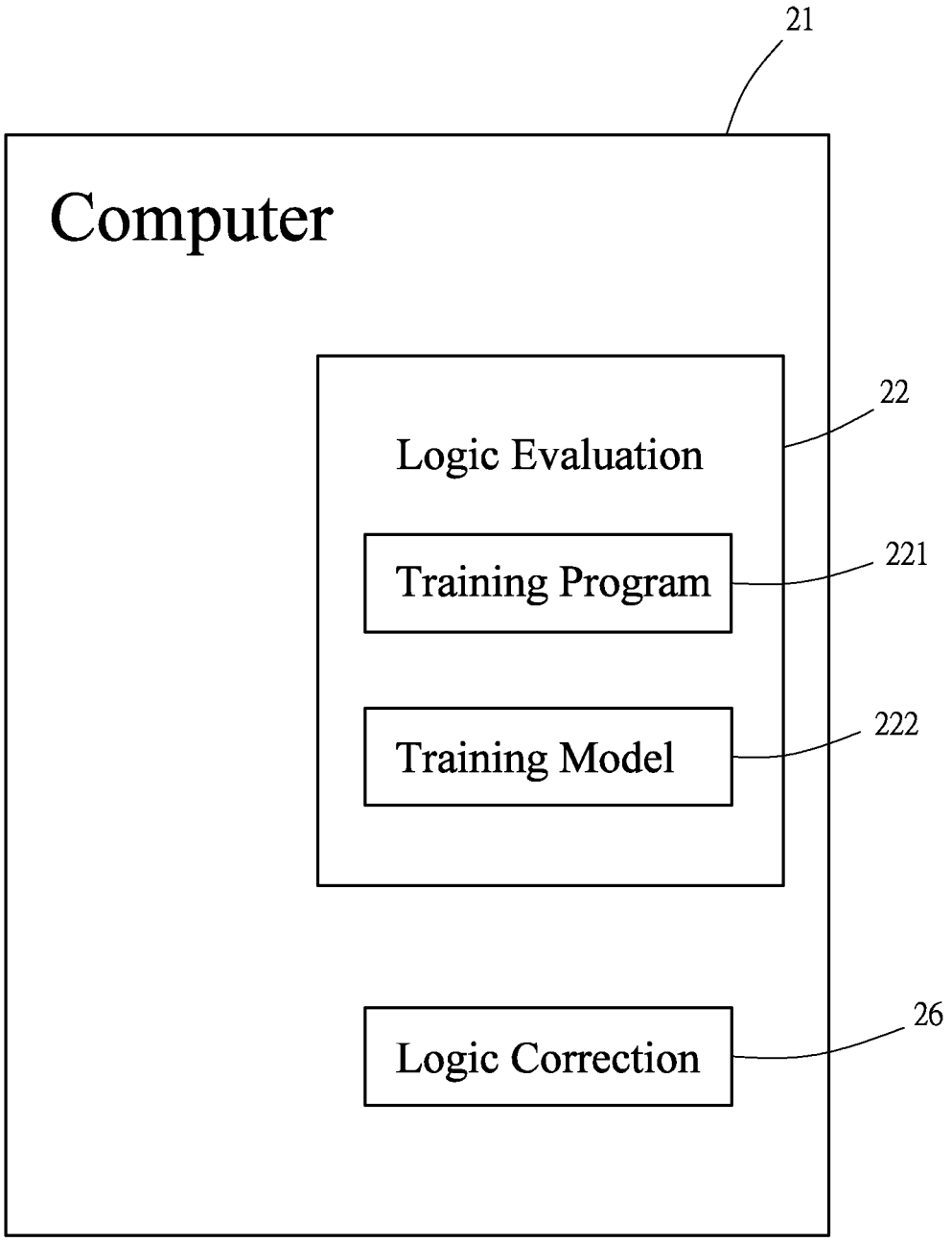
FIG. 2 is a block diagram according to the first exemplary embodiment of the present disclosure.
Figure 3:
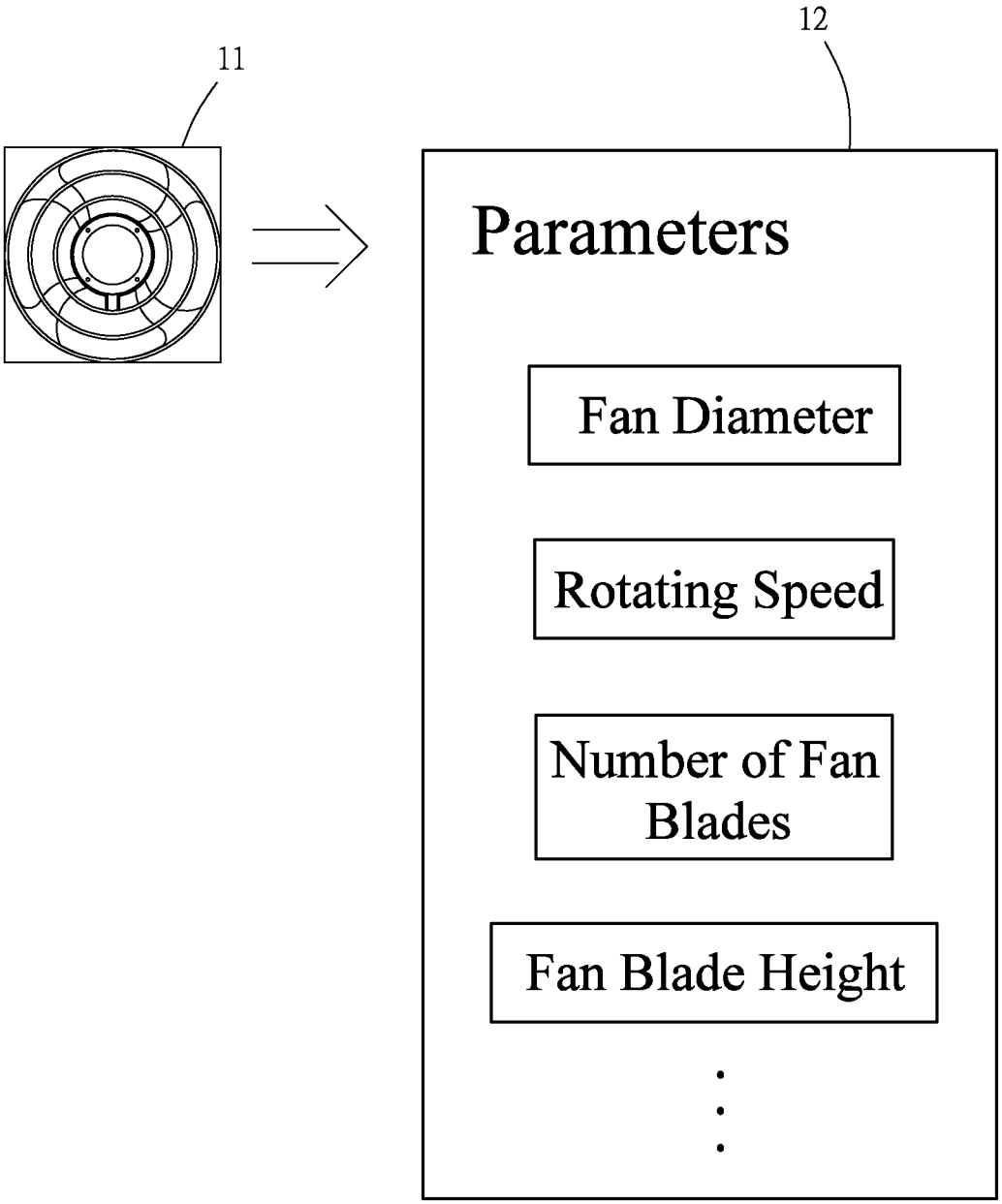
FIG. 3 is another block diagram according to the first exemplary embodiment of the present disclosure.
Figure 4:
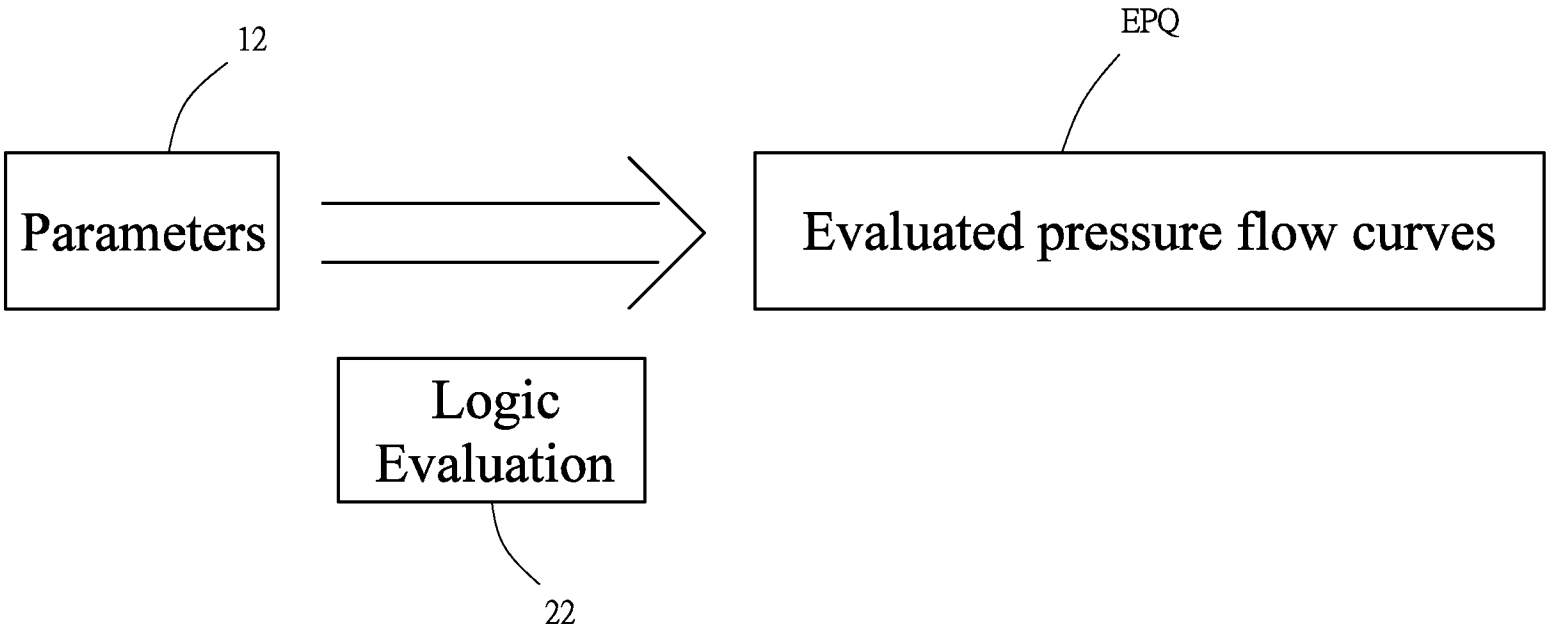
FIG. 4 is a schematic operation diagram according to the first exemplary embodiment of the present disclosure.
Figure 5:
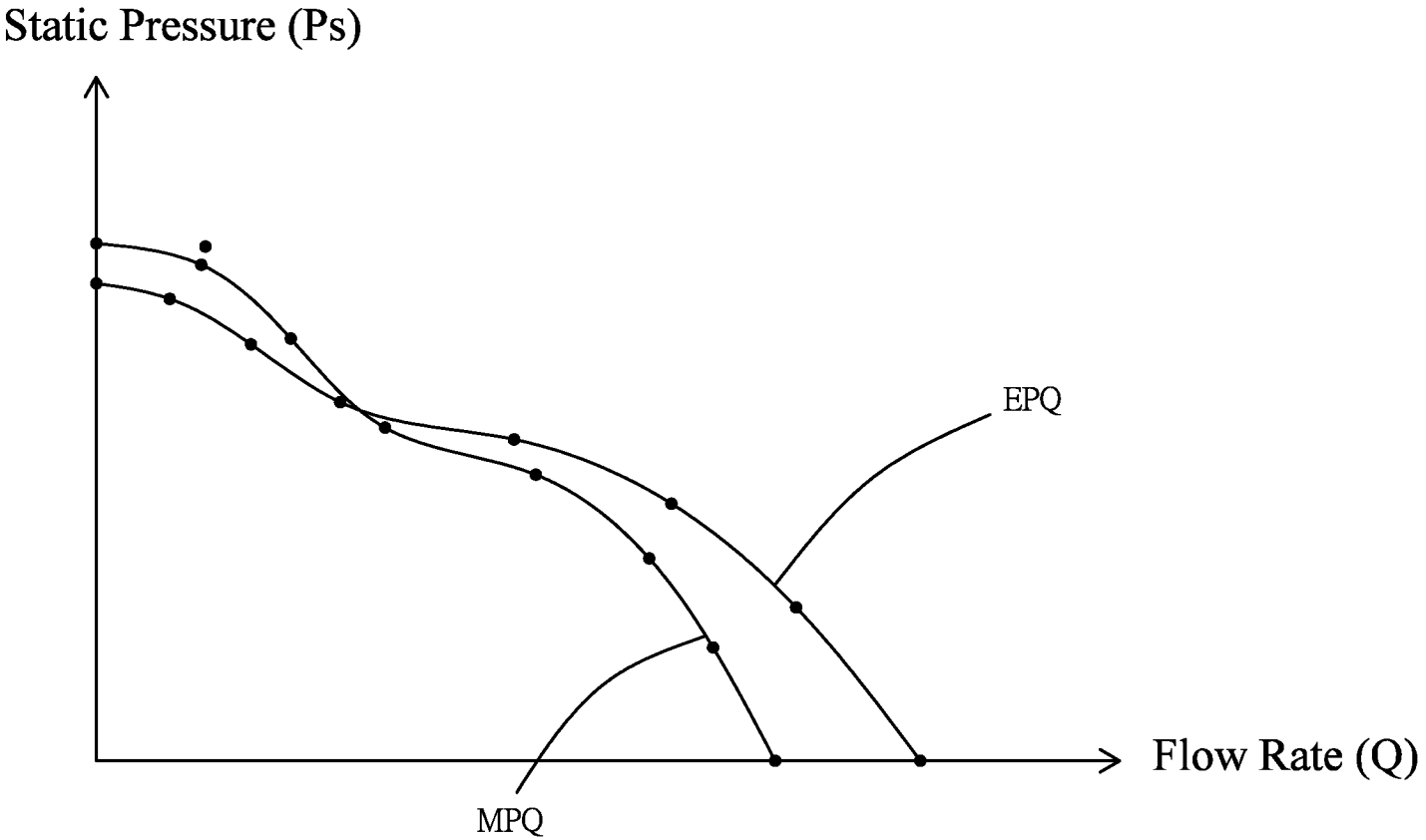
FIG. 5 is a schematic chart showing pressure curves according to the first exemplary embodiment of the present disclosure.

In step (a), a fan 11 as shown in FIGS. 1 to 3 is provided. The fan 11 corresponds to a set of parameters 12 that includes at least numerical values of the fan diameter, rotational speed, number of fan blades, and height of fan blades height. The set of parameters 12 is stored in a computer 21, and the fan 11 installed in a wind tunnel device 31. In the first preferred embodiment, an axial flow fan is used as an example for the fan 11, and the set of parameters 12 is as follows: the airfoil shape is NACA 4412; the blade root chord length is 25 mm; the blade end chord length is 35 mm; the mounting angle is 32 degrees; the torsion angle is 10 degrees; the fan diameter is 116 mm; the hub outer diameter is 50 mm; the number of blades is 9; the hub depth is 22 mm; the rotation speed is 3000 rpm; the blade top clearance 2 mm; and fan frame height is 25 mm.

In step (b), as shown in FIGS. 2 to 5, the computer 21 executes a logic evaluation 22, which, when executed, converts an evaluated pressure flow curve EPQ based on the set of parameters 12, and measures the air flow into or out of the wind tunnel device 31 during operation of the fan 11 by ways of a measurement device 32 provided by the wind tunnel device 31 to obtain a measured pressure flow curve MPQ. In the first embodiment, the logic evaluation 22 has a training program 221 and a training model 222. The training program 221 can pre-program different sets of parameters 12 corresponding to each of the plurality of fans of same kind or model, and the different sets of parameters corresponding to each of the aforementioned plurality of fans of same kind or model in a neural network. The training model 222 is constructed by instructing the training program 221 on the different sets of parameters corresponding to each of the multiple fans and the different measured pressure flow curves MPQs corresponding to each of the multiple fans.

Figure 6:
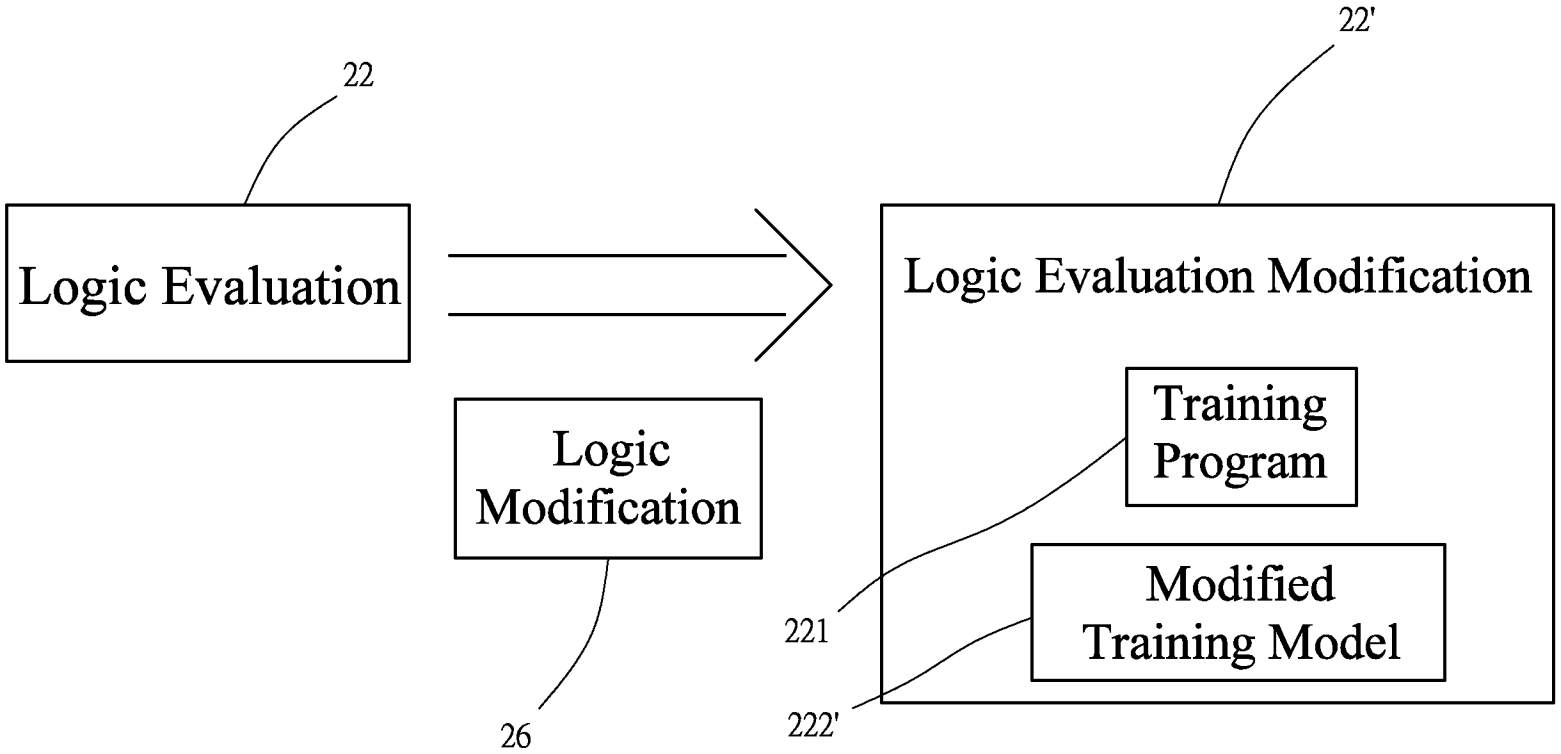
FIG. 6 is another schematic operation diagram according to the first preferred embodiment of the present disclosure.

In step (c), as shown in FIG. 6, the computer 21 is used to execute a logic modification 26, which is to modify or correct the logic evaluation 22 according to the difference between the measured pressure flow curve MPQ and the evaluation pressure flow curve EPQ, thereby obtaining a logic evaluation modification 22'. In particular, when the computer 21 performs the logic evaluation modification 22' to convert the set of parameters 12, the new evaluated pressure flow curve (not shown in the figure) obtained is necessarily closer to the measured pressure flow curve MPQ than the evaluation pressure flow curve EPQ obtained in the preceding step (b). In the first preferred embodiment, the logic modification 26 occurs when the difference between the sum of the measured pressure flow curve MPQ and the evaluated pressure flow curve EPQ reaches more than 5%, and the training program 221 feeds the measured pressure flow curve MPQ to the training model 222 to retrain and obtain a modified training model 222'. As a result, the logic evaluation modification 22' contains the modified training model 222' and the training program 221.

In step (d), the logic evaluation 22 in the preceding step (b) is replaced with the logic evaluation modification 22'.

In step (e), the aforementioned steps (a) to (d) are repeated, each time with the same fan 11 or of a different fan as compared to the previous fan 11.

Figure 7:
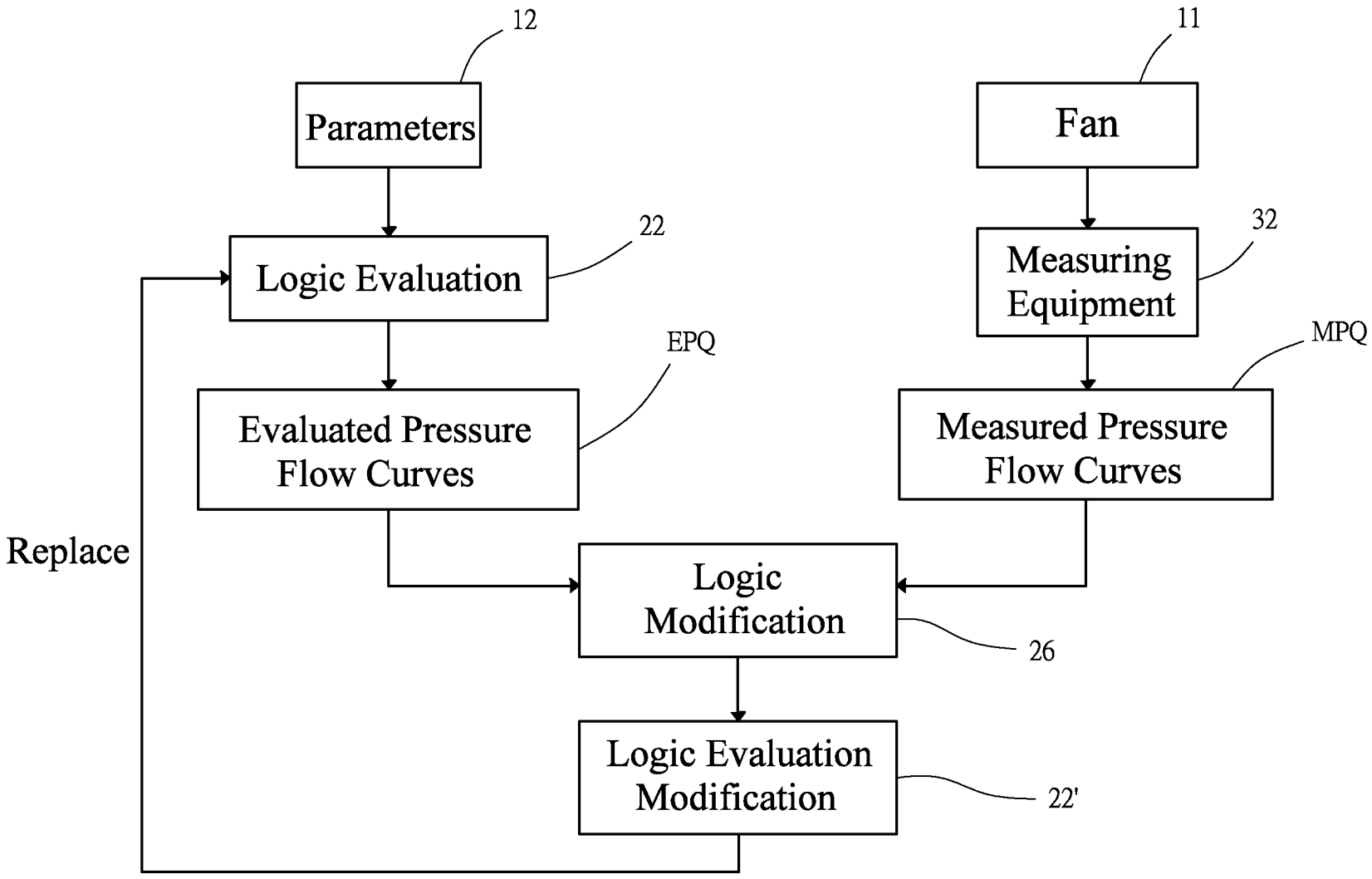
FIG. 7 is a flow chart according to the first exemplary embodiment of the present disclosure.

FIG. 7 shows the overall flow of the first preferred embodiment of the present disclosure as follows: From the above steps, the method of the present disclosure is to first train each set of parameters 12 corresponding to a number of fans (i.e., the fan 11 and new different fans) with the MPQ of the measured pressure flow curve in the neural network, so that the resulting training model 222 is the developed training model 222 that is close to the MPQ of the measured pressure flow curve. However, by going through the aforementioned steps (a) through (e), the logic evaluation 22 can be continuously revised so that the final evaluated pressure flow curve EPQ of the disclosure is closer to the MPQ of the fan 11 or the new different fan. As a result, the final evaluation pressure and flow curve EPQ are closer to the measured pressure and flow curve MPQ of the fan 11 or the new different fan.

As can be seen from the above, the method provided by the first embodiment of the disclosure can evaluate the pressure flow curve EPQ of the fan 11 at the design stage of the fan 11, and the logic evaluation 22' can be continuously improved with the increase of the number of actual measurements of the designed fan, so that the logic evaluation 22 will be more and more similar to the actual measured pressure flow curve MPQ for each fan 11. The designer can decide whether to use the evaluated pressure flow curve EPQ as the actual pressure flow curve MPQ without manufacturing the actual product according to his/her needs.

It should be added that although the fan used in the first embodiment of the disclosure is an axial flow fan for example, the disclosure is not limited to axial flow fans, but other types of fans such as centrifugal fans, oblique flow fans, and cross flow fans can also be applied to the method disclosed in the first embodiment of the invention.

Figure 8:
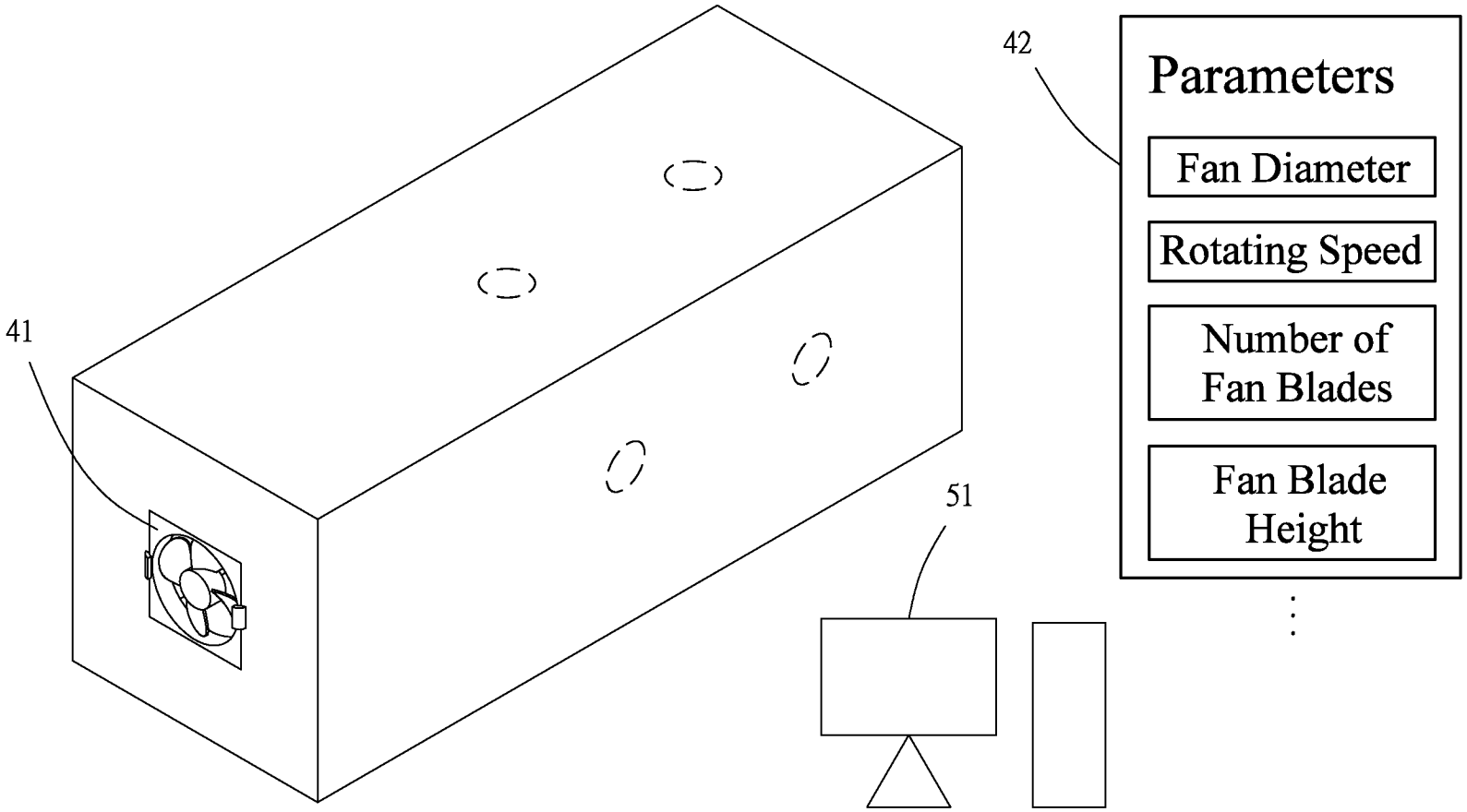
FIG. 8 is a perspective structure diagram containing a block diagram according to a second exemplary embodiment of the present disclosure.
Figure 9:
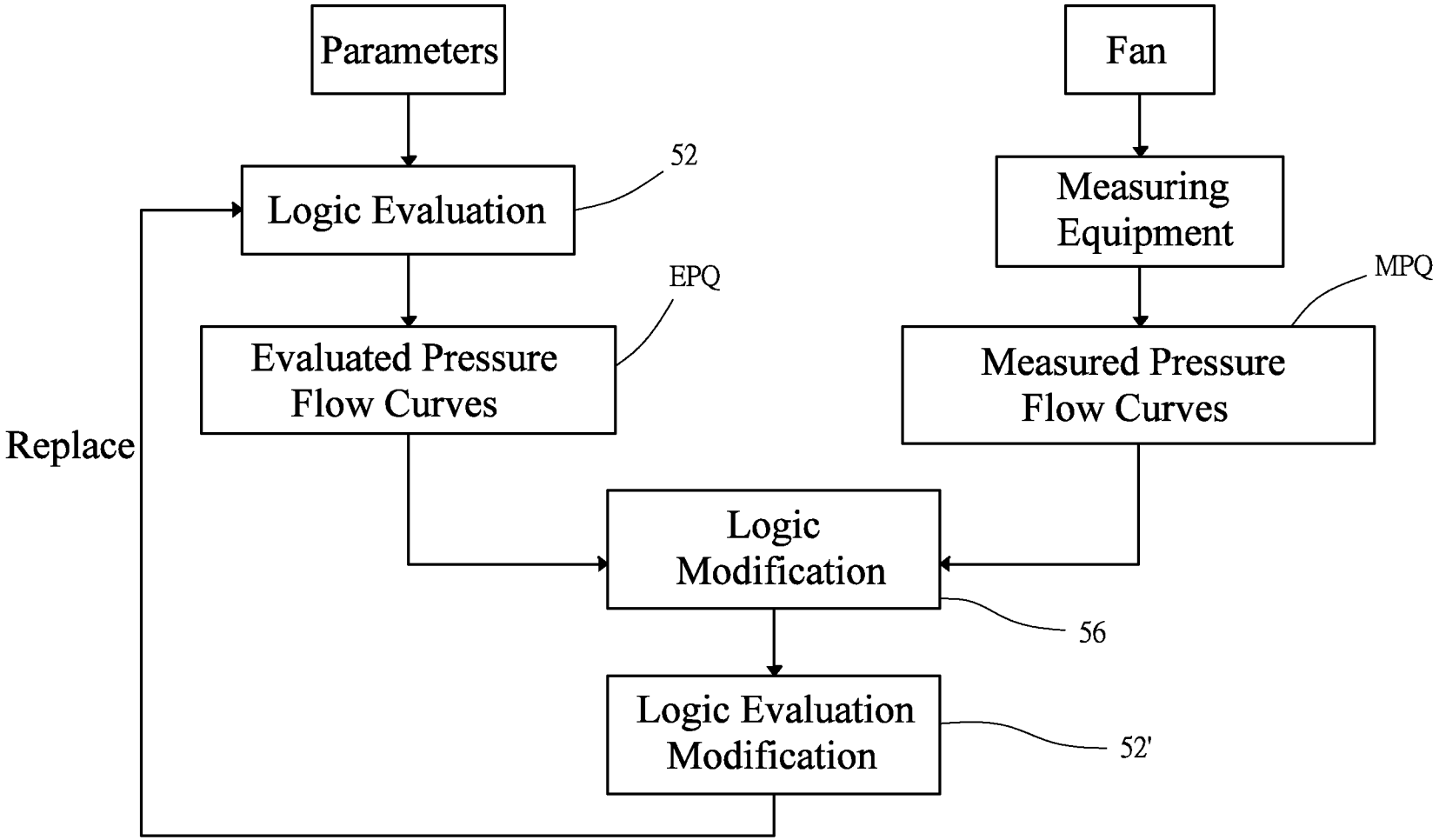
FIG. 9 is a flow chart according to the second exemplary embodiment of the present disclosure.

As shown in FIGS. 8 and 9, a second preferred embodiment of the present disclosure uses another method for continuously improving the logic of fan evaluation, the technical content of which is substantially the same as that of the first embodiment, with the differences as discussed below.

In step (b), the logic evaluation 22 does not use any neural network techniques, but has an operator who implements, as examples, the following calculation equations:

$$Ps=P\max*[(Q\max-Q)/Q\max]\hat{}0.75$$

$$Q=Q\max*(P\max-Ps)/P\max$$

$$P\max=\rho*(\mathrm{OD}+\mathrm{ID})\hat{}2*rpm\hat{}2*(A1/A)\hat{}2*\cos(\theta)/4.$$

$$Q\max=(\mathrm{OD}+\mathrm{ID})*rpm*(\mathrm{OD}\hat{}2-\mathrm{ID}\hat{}2)*(A/A1)\hat{}0.5*\sin(\theta)/2.$$

Specifically, OD is the outer diameter of the fan blade; ID is the inner diameter of the fan blade; ρ is the air density; rpm is the rotating speed; A1 is the projected area of the blade; A is the fan passage area; θ is mounting angle; Qmax is the maximum flow; Ps is the static pressure; and Pmax is the maximum static pressure.

The above calculation equations are merely exemplary, and for those who have general knowledge in the field of technology, the above calculation equations can be directly understood. In other words, the calculation equations are not limited to the aforementioned equations, and other known equations can be used to determine the evaluation pressure flow curve EPQ.

When the computer 51 executes the logic evaluation 52, it calculates the evaluation pressure flow curve EPQ by substituting the set of parameters 42 into the operation formulas, which are understandable to the person in the technical field.

In step (c), the logic modification 56 is to first compare the evaluation pressure flow curve EPQ and the measured pressure flow curve MPQ, and obtain a set of approximation values, which in this example is the least square error method. Then, the set of approximation values is used to adjust the calculation equation of the logic evaluation 52 to obtain a modified calculation equation, and the logic evaluation modification 52' contains examples of modified calculation equations as indicated below:

$$Ps=C1*P\max*[(Q\max-Q)/Q\max]\hat{}0.75.$$

$$Q=C2*Q\max*(P\max-Ps)/P\max.$$

$$P\max=C3*\rho*(OD+ID)\hat{}2*rpm\hat{}2*(A1/A)\hat{}2*\cos(\theta)/4.$$

$$Q\max=C4*(OD+ID)*rpm*(OD\hat{}2-ID\hat{}2)*(A/A1)\hat{}0.5*\sin(\theta)/2.$$

Specifically, C1 through C4 are correction coefficients. When determining the values of the aforementioned C1 through C4, existing deep learning techniques can be used to conduct data mining, inappropriate data removal, and feature screening according to the set of approximation values, through the process of data mining, inappropriate data elimination, and feature screening, the aforementioned values of C1 through C4 are determined.

In addition, among the aforementioned parameters, the four calculation formulas of Ps, Q, Pmax, and Qmax will increase the calculation formulas affected by other characteristics, so the form of the aforementioned formulas may also vary with the actual fan form used. However, no matter what formulas are used, basically, at least four results of Ps, Q, Pmax, and Qmax must be obtained.

In the second embodiment, although the deep learning technology of the neural network is not used, the logic evaluation 52 is constantly revised by a method similar to machine learning, so that the logic evaluation 52 can be designed along with the design of the fan. The increase in the number of actual measurements will continuously improve the logic evaluation 52 with the logic evaluation modification 52', so that the evaluation pressure flow curve EPQ evaluated by the logic evaluation 52 for each fan 41 is closer to the actual measured pressure flow curve MPQ.

The rest of the technical features of this second embodiment and the effects achieved are the same as those of the first embodiment, and will not be repeated.

Figure 10:
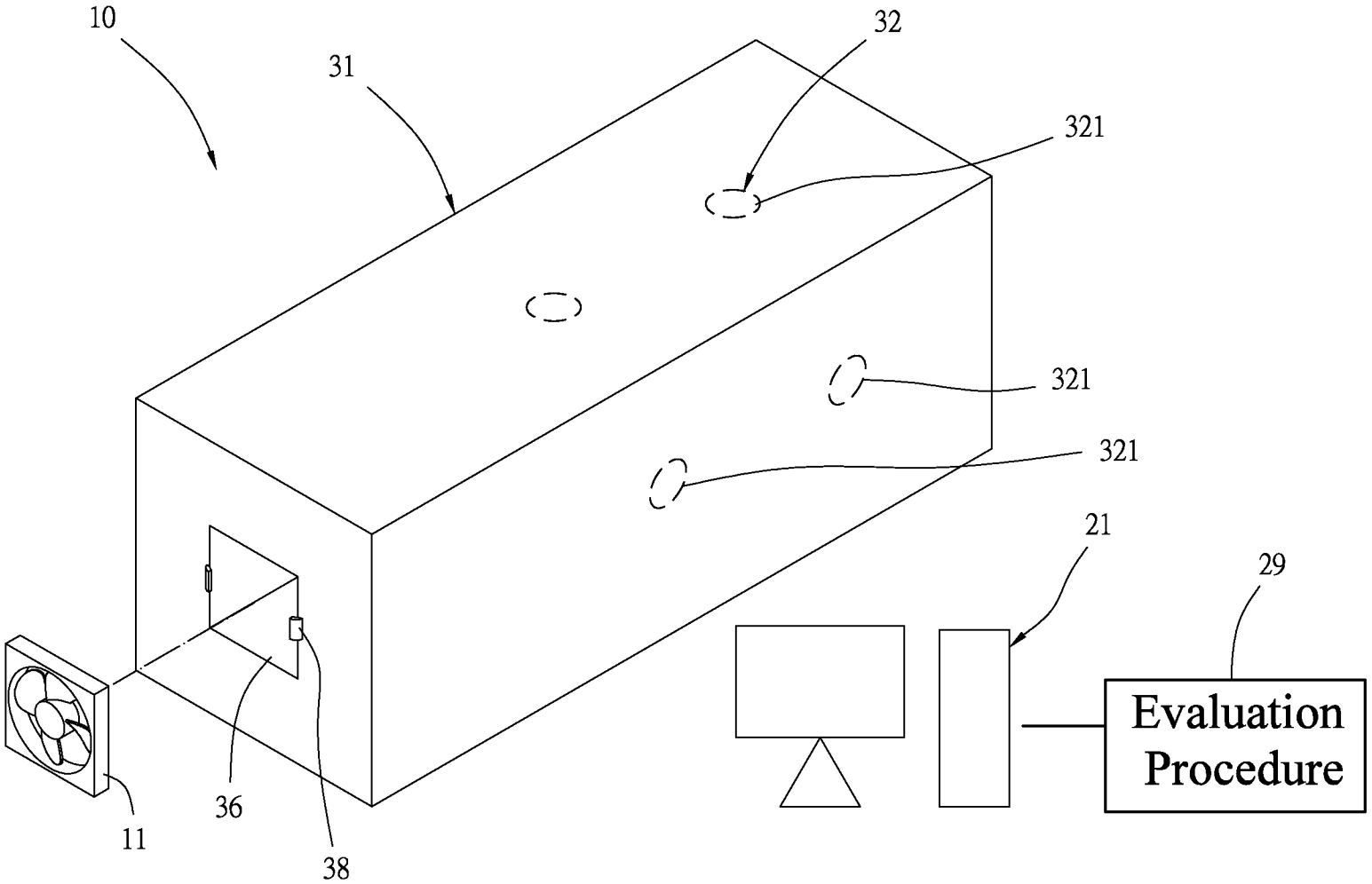
FIG. 10 is a perspective structure diagram according to a third exemplary embodiment of the present disclosure.

As shown in FIG. 10, a third preferred embodiment of the present disclosure uses a fan logic evaluation device 10, which consists primarily of the wind tunnel device 31, measurement device 32, and computer 21. The illustration numbers of the components in the third embodiment are the same as that of the first and second embodiments disclosed above.

In the third embodiment, the wind tunnel device 31 has an air vent 36 and a mounting structure 38 for the fan 11 to be mounted on, with an airflow driven by the operation of the fan 11 that enters the air vent 36. In the third embodiment, the mounting structure 38 is in the form of a clamp, and the ventilation port 36 is in the form that allows air to be blown in. In practice, the ventilation port 36 can also be implemented in the form of suction, and the implementation is not limited to the way of blowing air.

The measurement equipment 32 is installed inside the wind tunnel device 31. In the third embodiment, the measuring device 32 has a number of sensors 321, which are respectively installed at different locations within the wind tunnel device 31, and can measure a number of values.

The computer 21 is electrically connected to the measuring device 32 (the electrical connection is not shown in the figure), and reads one or more values sensed by the measuring device 32. The computer 21 performs an evaluation procedure 29, which covers steps (a) through (d) in the aforementioned first embodiment, with steps (b) and (c) in the aforementioned first embodiment that can also be changed to those in the aforementioned steps (b) and (c) of the second embodiment.

The operation of the third embodiment refers to the method steps described in the first or second embodiment, and thus will not be repeated here. Additionally, the effect that the third embodiment can achieve is generally the same as that of the first embodiment disclosed above, and will not be repeated here.

The present disclosure has been described with reference to the exemplary embodiments, and such description is not meant to be construed in a limiting sense. It should be understood that the scope of the present disclosure is not limited to the above-mentioned embodiment, but is limited by the accompanying claims. It is, therefore, contemplated that the appended claims will cover all modifications that fall within the true scope of the present disclosure. Without departing from the object and spirit of the present disclosure, various modifications to the embodiments are possible, but they remain within the scope of the present disclosure, will be apparent to persons skilled in the art.

What is claimed is:

1. A method for continuously improving a logic evaluation of a fan, including the steps of:

(a) preparing a fan installed in a wind tunnel device, wherein the fan corresponds to a set of parameters, the set of parameters at least include the values of fan diameter, speed, number of blades and height of fan blades, which are stored in a computer;

(b) executing a logic evaluation with the computer, wherein when the logic evaluation is executed, an evaluation pressure flow curve is converted based on the set of parameters, and the wind tunnel device is equipped with a measuring device to measure air flow blown into or out of the wind tunnel device when the fan is running, and a measured pressure flow curve is obtained, and inputted into the computer;

(c) executing a logic modification from the computer, wherein the logic evaluation is revised according to the difference between the measured pressure-flow curve and the estimated pressure-flow curve, and obtain a logic evaluation modification, and wherein, when the computer executes the logic evaluation modification, the new estimated pressure-flow curve obtained must be closer to the measured pressure-flow curve than the estimated pressure-flow curve obtained in the aforementioned step (b);

(d) replacing the logic evaluation in the aforementioned step (b) with the logic evaluation modification; and (e) repeating the above steps (a) to (d), with each repetition having the same fan or of a different fan.

2. The method for continuously improving the logic evaluation of the fan according to claim 1, wherein:

in step (b), the logic evaluation has a training program and a training model, and the training model is formed by the training program, which is accomplished by pre-training different groups of parameters corresponding to multiple fans and different measured pressure-flow curves corresponding to the aforementioned multiple fans with a neural network; and in step (c), the logic modification uses the training program for feeding back the measured pressure-flow curve to the training model to obtain a modified training model, and the logic evaluation modification includes the modified training model and the training program.

3. The method for continuously improving the logic evaluation of the fan according to claim 1, wherein:

in step (b), the logic evaluation has a set of calculation formulas, and when the computer executes the logic evaluation, the set of the parameters is placed into the calculation formulas to calculate the evaluation pressure-flow curve; and in step (c), the logic modification is carried out by comparing the evaluation pressure-flow curve and the measured pressure-flow curve, obtaining the result as a set of approximate values, and adjusting the expression of the logic evaluation with the set of approximation values to obtain a revised expression, with the logic evaluation modification including the revised expression and having a set of modified calculation formulas.

4. The method for continuously improving the logic evaluation of the fan according to claim 3, wherein the set of calculation formulas is as follows:

$$Ps=P\max*[(Q\max-Q)/Q\max]\hat{}0.75$$

$$Q=Q\max*(P\max-Ps)/P\max$$

$$P\max=\rho*(OD+ID)\hat{}2*rpm\hat{}2*(A1/A)\hat{}2*\cos(\theta)/4;\text{ and}$$

$$Q\max=(OD+ID)*rpm*(OD\hat{}2-ID\hat{}2)*(A/A1)\hat{}0.5*\sin(\theta)/2,$$

wherein, OD is the outer diameter of the fan blade, ID is the inner diameter of the fan blade; ρ is the air density; rpm is the rotating speed, A1 is the projected area of the blade, A is the fan passage area, θ is mounting angle, Qmax is the maximum flow, Ps is the static pressure, and Pmax is the maximum static pressure, and wherein the set of modified calculation formulas is as follows:

$$Ps=C1*P\max*[(Q\max-Q)/Q\max]\hat{}0.75;$$

$$Q=C2*Q\max*(P\max-Ps)/P\max;$$

$$P\max=C3*\rho*(OD+ID)\hat{}2*rpm\hat{}2*(A1/A)\hat{}2*\cos(\theta)/4;\text{ and}$$

$$Q\max=C4*(OD+ID)*rpm*(OD\hat{}2-ID\hat{}2)*(A/A1)\hat{}0.5*\sin(\theta)/2,$$

with C1 through C4 as correction coefficients.

5. The method for continuously improving the logic evaluation of the fan according to claim 3, wherein when comparing the estimated pressure-flow curve and the measured pressure-flow curve, the least square error method is used for comparison.

6. A fan logic evaluation device according to a process comprising the steps of:

(a) preparing a fan installed in a wind tunnel device, wherein the fan corresponds to a set of parameters, the set of parameters at least include the values of fan diameter, speed, number of blades and height of fan blades, which are stored in a computer;

(b) executing a logic evaluation with the computer, wherein when the logic evaluation is executed, an evaluation pressure flow curve is converted based on the set of parameters, and the wind tunnel device is equipped with a measuring device to measure air flow blown into or out of the wind tunnel device when the fan is running, and a measured pressure flow curve is obtained, and inputted into the computer;

(c) executing a logic modification from the computer, wherein the logic evaluation is revised according to the difference between the measured pressure-flow curve and the estimated pressure-flow curve, and obtain a logic evaluation modification, and wherein, when the computer executes the logic evaluation modification, the new estimated pressure-flow curve obtained must be closer to the measured pressure-flow curve than the estimated pressure-flow curve obtained in the aforementioned step (b);

(d) replacing the logic evaluation in the aforementioned step (b) with the logic evaluation modification; and (e) repeating the above steps (a) to (d), with each repetition having the same fan or of a different fan, wherein the fan logic evaluation device comprises:

the wind tunnel device having an air vent and a mounting structure for the fan to be mounted on the air vent and for accommodating an airflow driven by the operation of the fan;

a measuring device installed on the wind tunnel device; and the computer, electrically connected to the measuring device for reading the values sensed by the measuring device, and performing an evaluation procedure comprising the steps (a) through (d).

7. The fan logic evaluation device according to claim 6, wherein the installation structure is a fixture.

8. The fan logic evaluation device according to claim 6, wherein the measurement equipment has a plurality of sensors, which are respectively installed at different positions in the wind tunnel device.

* * * * *